US006612971B1

(12) United States Patent
Morris

(10) Patent No.: US 6,612,971 B1
(45) Date of Patent: Sep. 2, 2003

(54) EXERCISE MACHINE

(76) Inventor: Phillip E. Morris, 1301 Jane La., Greenwood, MS (US) 38930

( * ) Notice: Subject to any disclaimer, the term of this patent is extended or adjusted under 35 U.S.C. 154(b) by 0 days.

(21) Appl. No.: 09/568,045

(22) Filed: May 10, 2000

(51) Int. Cl.[7] ..... A63B 71/00

(52) U.S. Cl. ..... 482/74; 482/14; 482/93; 473/441; 73/379.06

(58) Field of Search ..... 482/14, 136, 51, 482/137, 57, 148, 58, 59, 61, 68, 74, 93, 118, 119; 473/441, 442, 445; 273/451; 73/379.06; 280/47.34, 47.33, 1.5

(56) References Cited

U.S. PATENT DOCUMENTS

| | | | | | |
|---|---|---|---|---|---|
| 3,062,548 | A | | 11/1962 | Foster et al. | 273/55 |
| 3,326,553 | A | | 6/1967 | Forrest | 273/55 |
| 3,352,426 | A | * | 11/1967 | Carlson | 211/22 |
| 3,972,238 | A | | 8/1976 | Thatcher | 73/380 |
| 4,387,908 | A | | 6/1983 | Kroger et al. | 280/63 |
| 4,447,056 | A | | 5/1984 | Dalton | 273/55 |
| 4,451,037 | A | | 5/1984 | O'Hare | 273/55 |
| 4,838,565 | A | | 6/1989 | Douglas et al. | 280/1.5 |
| 4,844,459 | A | | 7/1989 | Francis et al. | 273/55 |
| 4,867,439 | A | | 9/1989 | Salyer | 272/70.3 |
| 5,070,816 | A | | 12/1991 | Wehrell | 119/29 |
| 5,197,931 | A | | 3/1993 | Wroclawsky | 482/74 |
| 5,375,861 | A | | 12/1994 | Gifford | 280/47.38 |
| 5,743,821 | A | | 4/1998 | Wirachowski | 473/441 |
| 6,299,195 | B1 | * | 10/2001 | Chan | 280/651 |

* cited by examiner

*Primary Examiner*—Nicholas D. Lucchesi
*Assistant Examiner*—Tam Nguyen
(74) *Attorney, Agent, or Firm*—Kenyon & Kenyon

(57) ABSTRACT

An exercise machine is disclosed. In an embodiment for an exercise machine in accordance with the principles of the present invention, the exercise machine includes a frame having a first axle support and a second axle support. A roller is disposed between the first axle support and the second axle support. An axle extends through the roller and includes a portion extending external to the second axle support. A variable resistance mechanism is coupled to the external portion of the axle.

22 Claims, 9 Drawing Sheets

EXERCISE MACHINE

BACKGROUND OF THE INVENTION

1. Field of the Invention

The present invention relates generally to an exercise machine. More specifically, the invention provides an exercise machine that includes a mechanism for variably adjusting the resistance provided by the exercise machine.

2. Description of the Related Art

Generally, exercise machines that are designed to be pulled or pushed by a user are known. These types of exercise machines may be utilized for any of a variety of purposes, including to strengthen the legs of the user as a result of the user pulling or pushing the exercise machine. These machines generally provide a resistance against being pushed or pulled and thus, the effort required by the user to overcome the resistance provided by the machine improves the strength of the user. An example of a known exercise machine as described above for these purposes is a sled that is pushed by a football player.

It is also generally known to provide exercise machines as described above that are able to provide variable resistance to the user. However, these known types of exercise machines generally utilize relatively complex apparatuses to provide the variable resistance and may be relatively large apparatuses. Therefore, it would be desirable to provide an improved exercise machine that includes a mechanism for variably adjusting the resistance provided by the exercise machine.

SUMMARY OF THE INVENTION

An exercise machine is provided. In an embodiment for an exercise machine in accordance with the principles of the present invention, the exercise machine includes a frame having a first axle support and a second axle support. A roller is disposed between the first axle support and the second axle support. An axle extends through the roller and includes a portion extending external to the second axle support. A variable resistance mechanism is coupled to the external portion of the axle.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
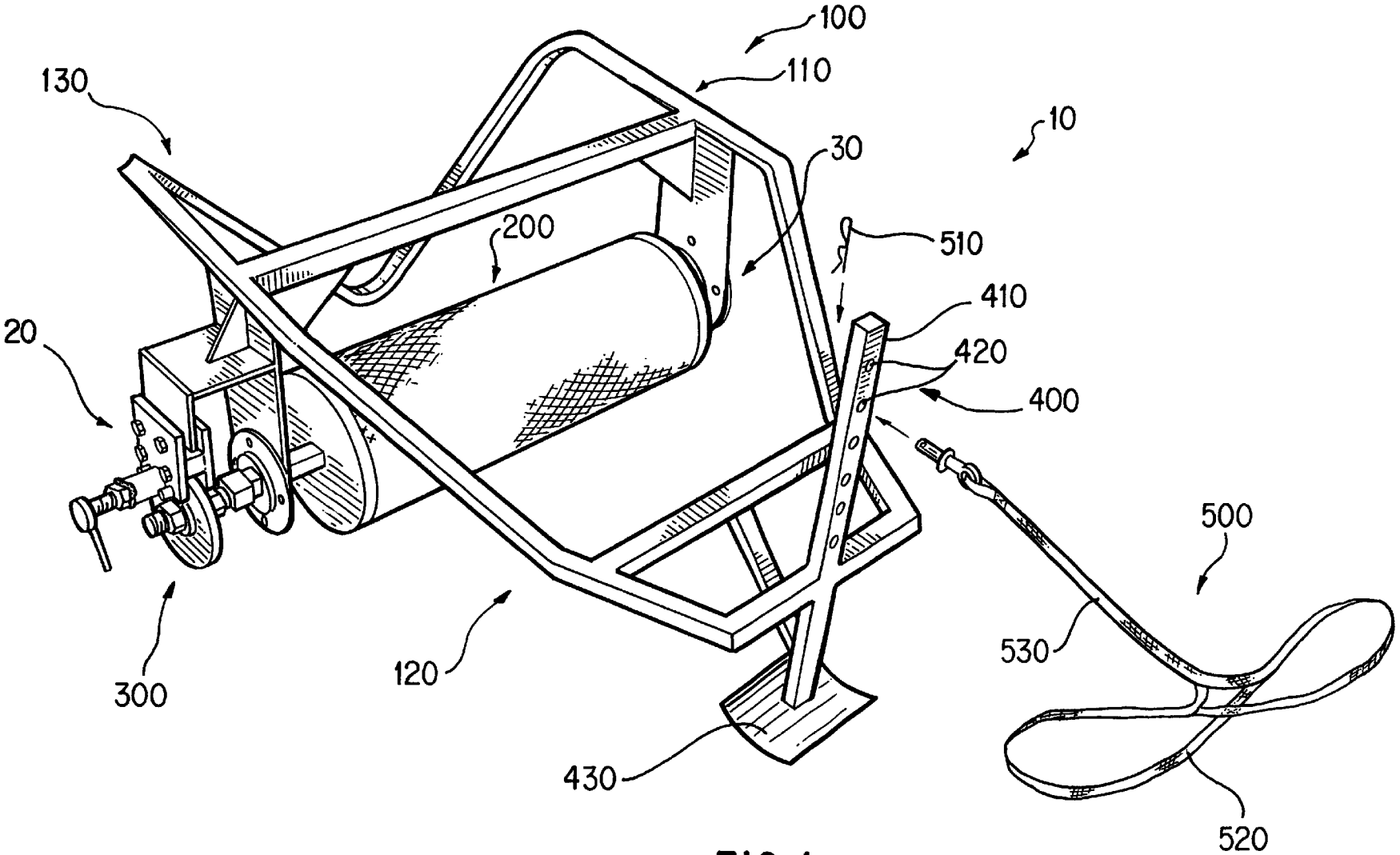
FIG. 1 is a perspective view of an embodiment of an exercise machine in accordance with the principles of the present invention.

FIG. 1 illustrates a first embodiment of an exercise machine 10 in accordance with the principles of the present invention. As can be seen, and as will be described further later in this specification, exercise machine 10 is comprised of a frame 100, a roller 200, a variable resistance mechanism 300, a support member 400, and a harness assembly 500. As will also be further described later in this specification, in order to utilize exercise machine 10, a user straps the harness assembly 500 around his/her shoulders and then pulls the exercise machine 10 along the ground behind the user. Resistance against the pulling force applied by the user is provided by the exercise machine 10, and more particularly, by roller 200 and variable resistance mechanism 300. Variable resistance mechanism 300 provides for adjusting the resistance supplied by the exercise machine 10, and thus roller 200. Thus, as can be understood, pulling of the exercise machine 10 allows the user to develop the strength in the user's body, particularly the user's legs.

Figure 2:
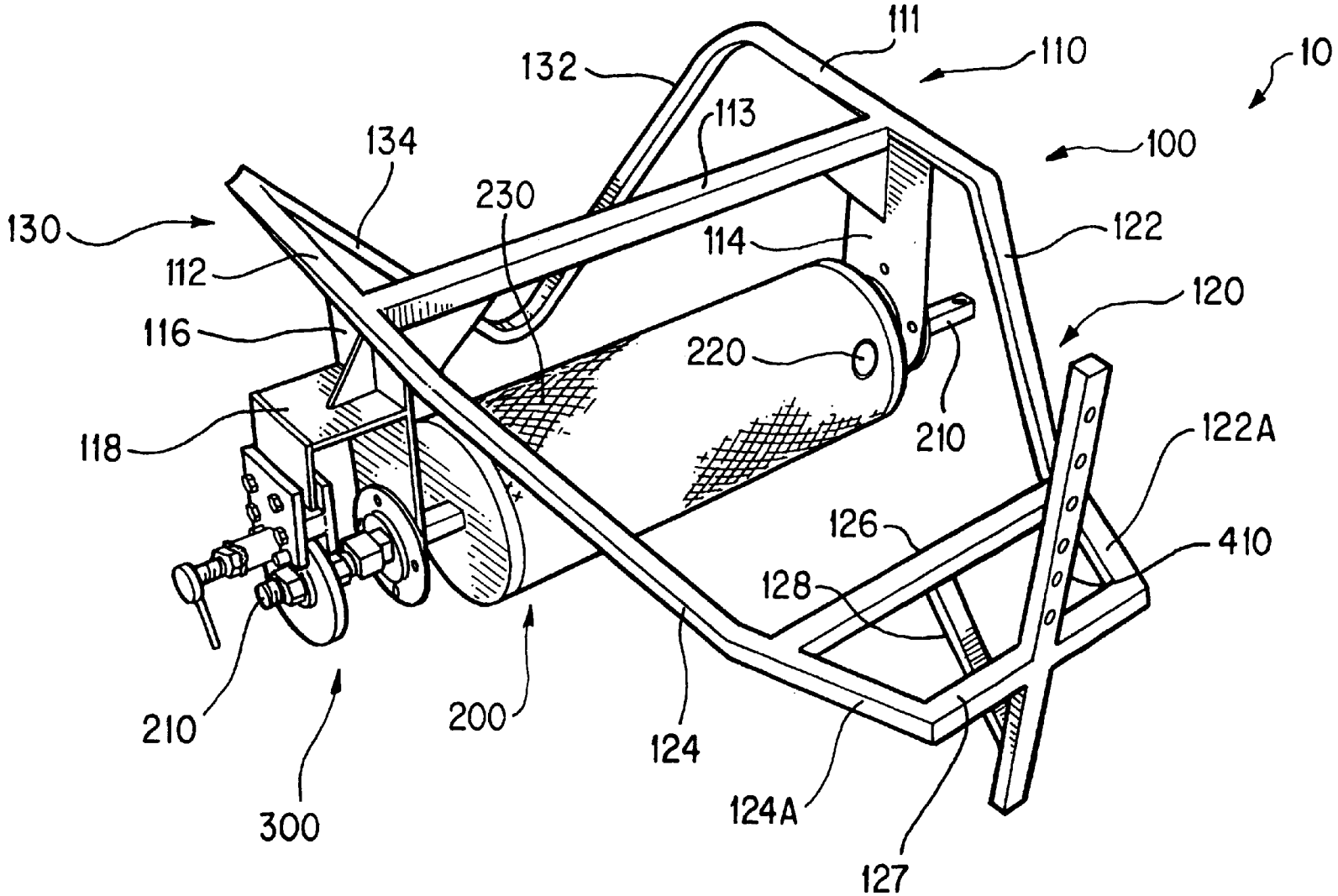
FIG. 2 is another perspective view of the exercise machine of FIG. 1.

As can be seen in FIG. 1, and as further seen in FIG. 2, frame 100 includes an overhead frame 110, a front frame 120, and a rear frame 130. Frame 100 is formed generally in an inverted u-shape and defines an internal area defined by overhead frame 110, front frame 120, and rear frame 130.

Overhead frame 110 is comprised of a first arm 111, a second arm 112, and a third arm 113 which interconnects first arm 111 and second arm 112 and which is oriented perpendicular to first arm 111 and second arm 112. As can be seen, overhead frame 110 is oriented generally above roller 200. In further describing overhead frame 110, first axle support 114 extends from first arm 111 and second axle support 116 extends from second arm 112. The first and second axle supports 114, 116, respectively, extend perpendicularly from first arm 111 and second arm 112, respectively. As will be described further later in this specification, first axle support 114 and second axle support 116 receive within them axle 210 of roller 200.

Front frame 120 of frame 100 includes a first arm 122 and a second arm 124. First arm 122 and second arm 124 extend from an end of overhead frame 110 and extend downwardly and forwardly from overhead frame 110. First arm extension 122A extends from a second end of first arm 122 and second arm extension 124A extends from a second end of second arm 124. First and second arm extensions 122A, 124A, respectively, extend generally parallel to the surface upon which roller 200 rests. First cross member 126 extends generally perpendicular to first arm extension 122A and second arm extension 124A and is connected to the first ends of first arm extension 122A and second arm extension 124A. Extending downwardly and forwardly from first cross member 126 is support member 128. Support member 128 attaches at a first end to first cross member 126 and attaches at a second end to support member 400. Second cross member 127 extends generally perpendicularly to first arm extension 122A and second arm extension 124A and attaches at its distal ends to the second ends of first arm extension 122A and second arm extension 124A. Second cross member 127 attaches to support member 400 at a mid-portion of the second cross member. Thus, front frame 120 provides for interconnection between overhead frame 110 and support member 400.

Frame 100 also includes, as discussed previously, rear frame 130. Rear frame 130 includes a first arm 132 and a second arm 134. First arm 132 is attached at a first end to the second end of first arm 111 of overhead frame 110, which is the opposite end of first arm 111 from which extends first arm 122 of front frame 120. Second arm 134 is similarly attached to the second end of second arm 112 of overhead frame 110. First arm 132 and second arm 134 extend downwardly and rearwardly from overhead frame 110 and first arm 132 is interconnected with second arm 134 at the respective second ends of each arm, i.e., at ends opposite the ends from which the arms attach to the overhead frame's arms 111, 112. Thus, first arm 132 and second arm 134 of rear frame 130 generally form a v-shaped structure. The point of connection between arm 132 and arm 134 is located at a position above the surface upon which roller 200 rests. Whereas the distance that the interconnection point between first arm 132 and second arm 134 is positioned above the ground surface is not rigidly defined, it is of a sufficient distance such that, if the frame 100 was rotated backward around roller 200 and thus support member 400 was raised from the ground, the connection point between first arm 132 and second arm 134 would engage the ground surface before the frame 100 could be fully rotated into a near-perpendicular orientation with respect to the ground surface. Thus, as can be understood, rear frame 130 provides a safety mechanism to prevent frame 100 from being tipped over backwards should the user inadvertently raise support member 400 to a height too high off of the ground surface.

Resistance mechanism frame extension member 118 is disposed on an external side of second axle support 116 and is thus disposed external to the internal area defined by overhead frame 110, front frame 120, and rear frame 130. Thus, frame extension member 118 extends externally from second axle support 116 in an external direction from the internal area of the exercise machine.

In continuing further with the description of exercise machine 10, as can be seen in FIGS. 1 and 2, and as will be described further later in this specification in connection with FIG. 9, roller 200 is an elongated cylindrical member that is disposed for rotation within the internal area defined by frame 100. An axle 210 extends through roller 200. As will be described further, axle 210 has a square or rectangular cross-section at least along its length that extends within roller 200. Axle 210 is positioned within a complementary-shaped bore extending through roller 200 such that, as roller 200 is rotated, axle 210 rotates along with roller 200. As will also be further described later in this specification, axle 210, at its right end, which is defined as that end which includes variable resistance mechanism 300, includes a threaded portion at its distal-most end.

It is desirable that roller 200 be a relatively elongated member with a length, in an embodiment, of approximately 24 inches from end to end. Longer lengths are contemplated. For example, a roller of at least 36 inches or longer can be utilized with the present invention. It is desirable that roller 200 be of a relatively long length so that sufficient resistance can be provided to the user. As can be understood, the longer and heavier that roller 200 is, the greater the possible resistance is that can be provided against the user's pulling force.

Roller 200, in an embodiment, has a diameter of approximately 8 inches and is comprised of steel. Roller 200 may be hollow and thus, may include an aperture 220 in its outer structure such that, if it is desired to add weight to the roller to provide additional resistance to the user, weight may be added to the roller by inserting the weight through aperture 220. The present invention is not limited to any particular physical embodiment for the weight that may be added and thus, weight in the form of, for example, sand, water, lead, or steel may be added within roller 200.

Because exercise machine 10 may be utilized on any of a variety of ground surfaces, including an outdoor ground surface or an indoor floor surface, an appropriate material may be included on the exterior surface of roller 200. For example, if exercise machine 10 is utilized on an indoor floor surface, it may be desirable to include a material on the exterior surface of the roller, such as rubber, that would reduce the potential of damaging the floor's surface. If the exercise machine is used outdoors, it may be desirable to include a material on the exterior surface of the roller that would increase the resistance provided by the machine such as, for example, expanded metal. As such, FIGS. 1 and 2 illustrate roller 200 with a mesh 230 around its exterior. As discussed above, mesh 230 may be comprised of any of a variety of materials. Additionally, any material that may be applied to the exterior of the roller does not have to be comprised of a mesh, but rather, can be formed in any of a variety of structures, including a solid, or contiguous, structure or a non-contiguous structure.

As was also described previously, exercise machine 10 includes a variable resistance mechanism 300. As can be seen, variable resistance mechanism 300 is disposed external to the internal area defined by frame 100. Thus, variable resistance mechanism 300 is disposed external to overhead frame 110 and is disposed external to roller 200. Thus, variable resistance mechanism 300 is associated with resistance mechanism frame extension member 118 which extends externally from second axle support 116 of overhead frame 110. As will be further described later in this specification, variable resistance mechanism 300 applies a force to axle 210 which restrains axle 210, and thus roller 200, against rotation which in-turn provides resistance against the user's pulling force. As will also be further described later in this specification, the resistance that is applied by variable resistance mechanism 300 is variably adjustable. Thus, exercise machine 10 can be utilized for a variety of purposes. For example, a single user can adjust the resistance so that the resistance provided is appropriate for the workout that the user is trying to achieve or the resistance can be adjusted such that the resistance is appropriate for each of a plurality of different users. The variable resistance mechanism 300 will be described further later in connection with FIGS. 4–7.

Also shown in FIGS. 1 and 2 is an embodiment for support member 400. Support member 400 includes an attachment member 410 and a skid 430. Attachment member 410 extends generally perpendicular to the ground surface upon which roller 200 rolls and is attached to front frame 120 of frame 100. Skid 430 generally includes a flat surface and may be utilized in an embodiment where exercise machine 10 is used outdoors. Skid 430 supports exercise machine 10 at its forward end and may be dragged across the ground by the user when the user is pulling exercise machine 10 behind him/her. As will be discussed later in this specification, in an embodiment where exercise machine 10 is used indoors, skid 430 may be replaced with a wheel that would allow for rolling of support member 400 on the indoor surface, thus preventing potential damage to the indoor surface by the exercise machine 10. Attachment member 410 includes a plurality of apertures 420 along its length to provide for attachment of harness assembly 500 to support member 400.

Harness assembly 500 includes a coupler 510, a harness 520, and a tether 530 that interconnects coupler 510 lobe with harness 520. Coupler 510 may be any of a variety of structures, including a hooked pin, and is utilized to connect harness assembly 500 to support member 400. As discussed previously, the user attaches harness 520 to his/her body such that the user is able to pull exercise machine 10 behind them during the course of exercising with exercise machine 10. FIG. 1 illustrates an embodiment of a harness assembly and the present invention is not limited to any particular embodiment for a harness assembly. All that is required is that the user be able to engage with the exercise machine 10 such that the user is able to pull exercise machine 10 behind him/her.

Figure 3:
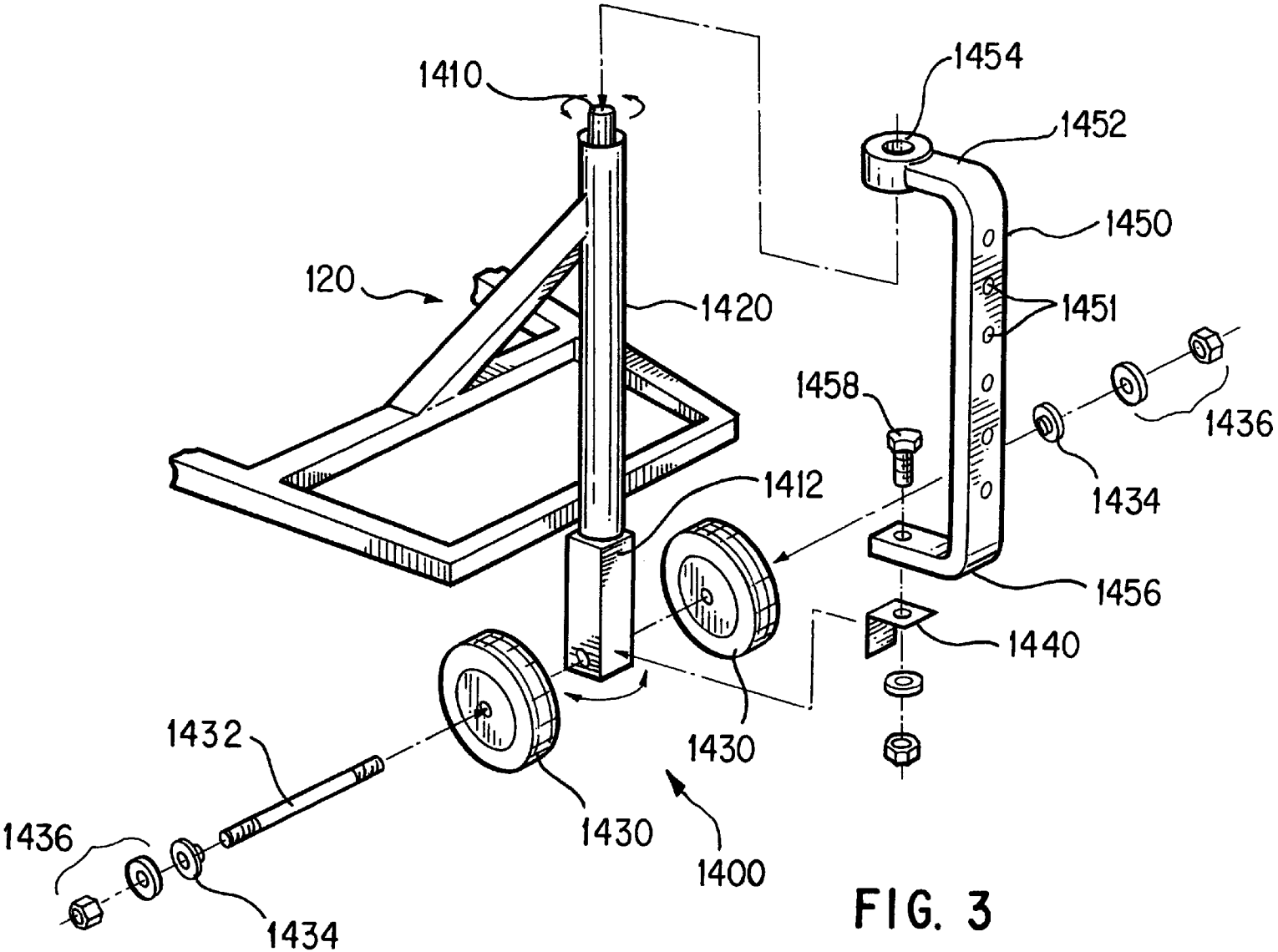
FIG. 3 is a perspective view of an alternative embodiment of a support member in accordance with the principles of the present invention.

FIG. 3 illustrates an alternative embodiment for a support member 1400. Support member 1400 includes a wheel(s) 1430 that, as described previously, may be utilized when exercise machine 10 is used indoors. As will be described, a portion of support member 1400 is rotatable in order to provide for ease in maneuvering exercise machine 10 on a floor surface such as, for example, a gymnasium floor.

In continuing further with the description of support member 1400, support member 1400 includes an attachment member 1410 that is rotatable within a rigid tube 1420. Rigid tube 1420 is rigidly secured to front frame 120 of frame 100. Rotatable attachment member 1410 is disposed within rigid tube 1420 and has attached to a lower end 1412 thereof wheel 1430. Wheel 1430 is retained on attachment member 1410 by axle 1432. Bearings 1434 and retainers 1436 may also be utilized to secure wheel 1430 onto axle 1432.

As can be seen in FIG. 3, lower end 1412 of rotatable attachment member 1410 may be formed with a square cross-section. Forming lower end 1412 in this configuration can provide for restraining lower end 1412 from being inserted any further within rigid tube 1420 due to the physical interaction of the structures of lower end 1412 and rigid tube 1420. For example, rigid tube 1420 can be formed as a tubular member with a circular cross-section and, as discussed above, lower end 1412 can be formed with a larger square cross-section. Thus, as can be understood, the larger square form of lower end 1412 could not be inserted within the smaller circular form of rigid tube 1420. The remaining portion of rotatable attachment member 1410, i.e., that portion above lower end 1412, would be complementary in form to rigid tube 1420, e.g., circular in cross-section, such that rotatable attachment member 1410 can be received within, and is rotatable within, rigid tube 1420.

In continuing with the discussion of support member 1400, support member 1400 also includes a harness bar 1450. Harness bar 1450 provides a structure for attachment of harness assembly 500, as discussed previously in connection with the embodiment of FIGS. 1 and 2. Harness bar 1450 is generally formed as an elongated u-shaped member and includes a first end 1452 and a second end 1456. First end 1452 includes a collar 1454 that is positioned around a top end of rotatable attachment member 1410. Second end 1456 is attached to lower end 1412 of rigid tube 1420 by utilization of an angle joint 1440 that is secured to the lower end 1412 of rigid tube 1420. Connection hardware 1458 is utilized to connect second end 1456 of harness bar 1450 to angle joint 1440. Thus, as can be understood, a user is able to rotate harness bar 1450 which in-turn rotates rotatable attachment member 1410 which further in-turn rotates wheel 1430. Thus, in this embodiment for an exercise machine, the exercise machine is able to freely rotate about rigid tube 1420 of support member 1400.

Figure 4:
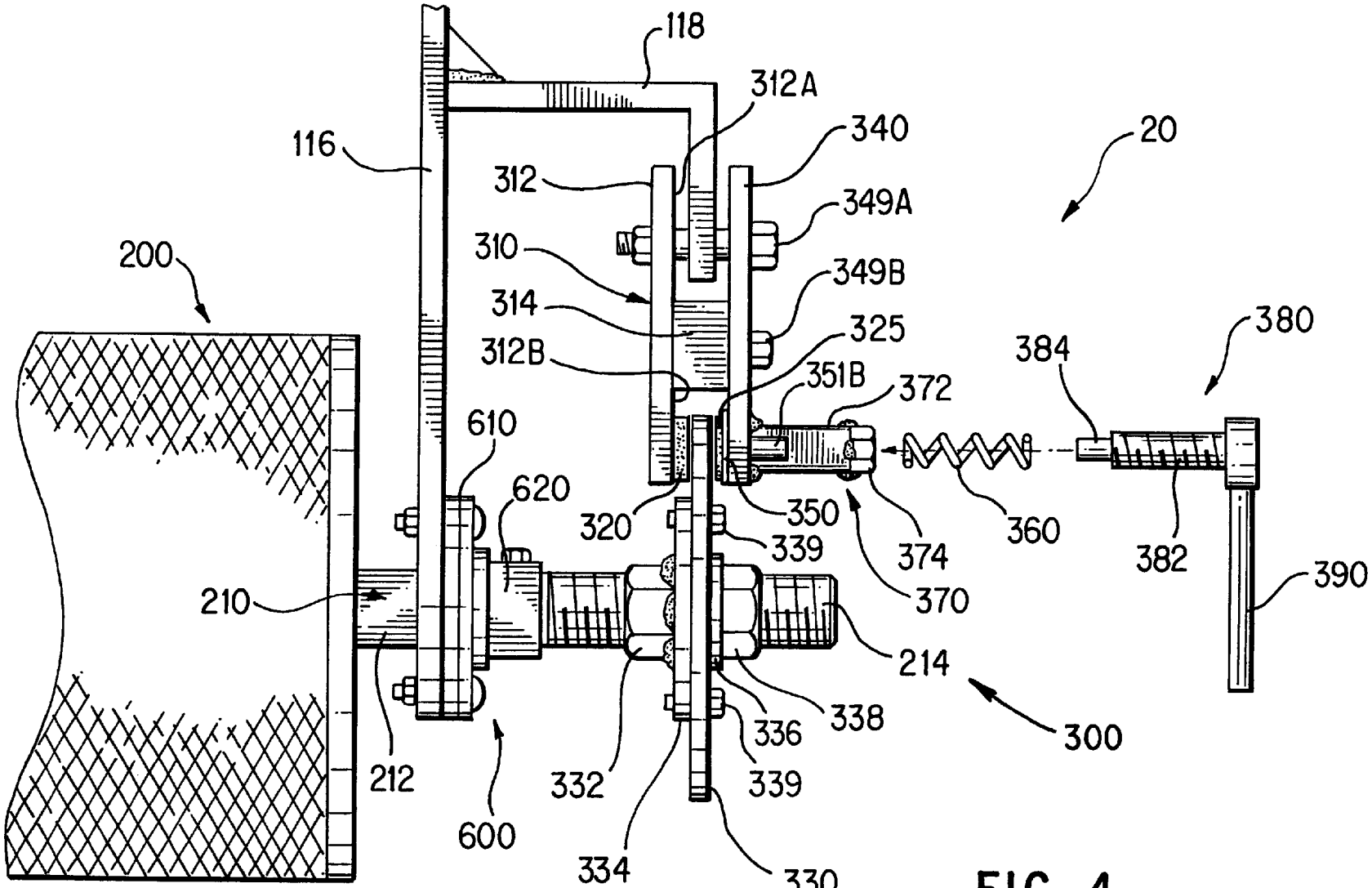
FIG. 4 is a partially exploded rear view of the right side of the exercise machine.
Figure 5:
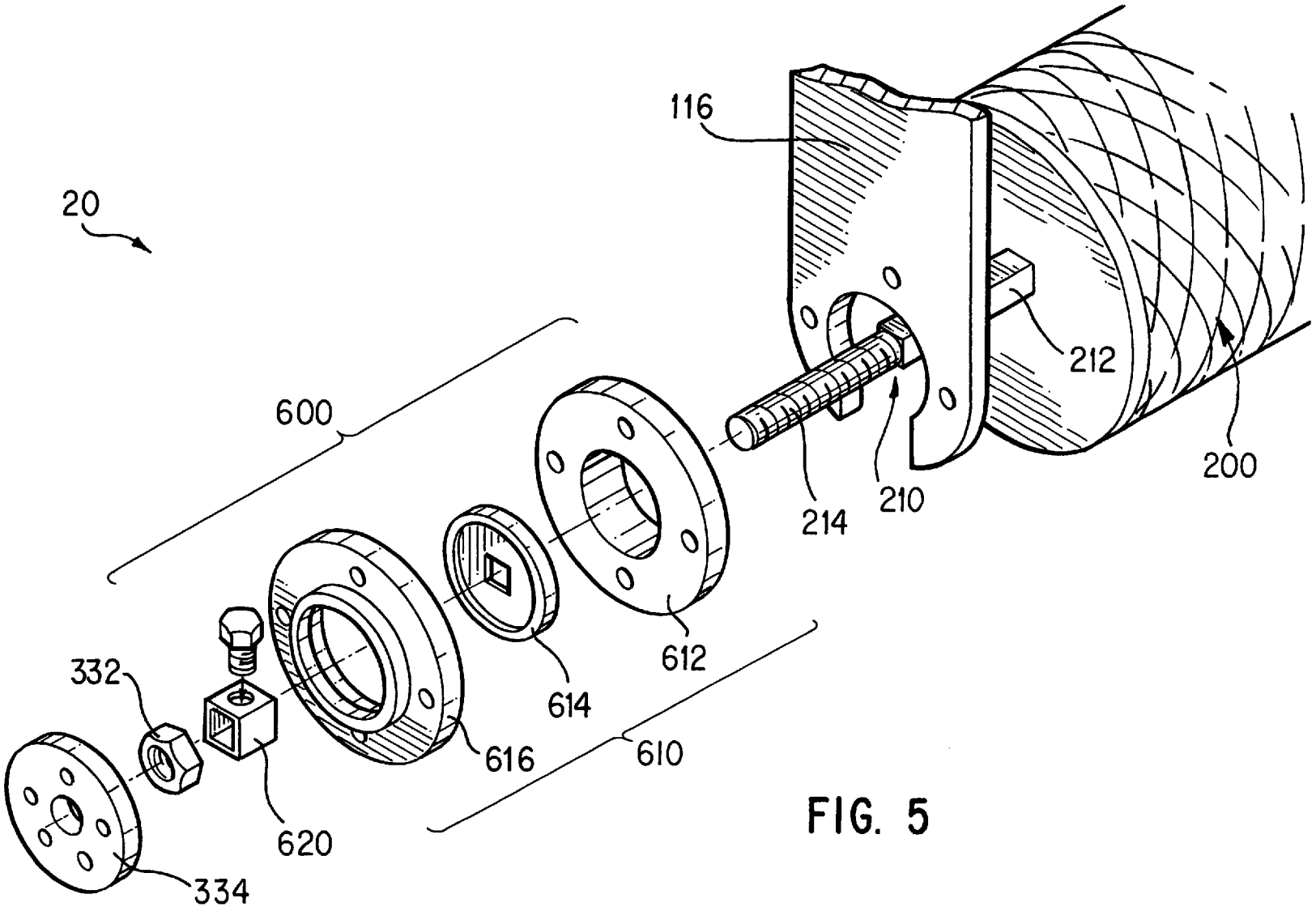
FIG. 5 is an exploded view of a portion of the components included in the right side of the exercise machine.
Figure 6:
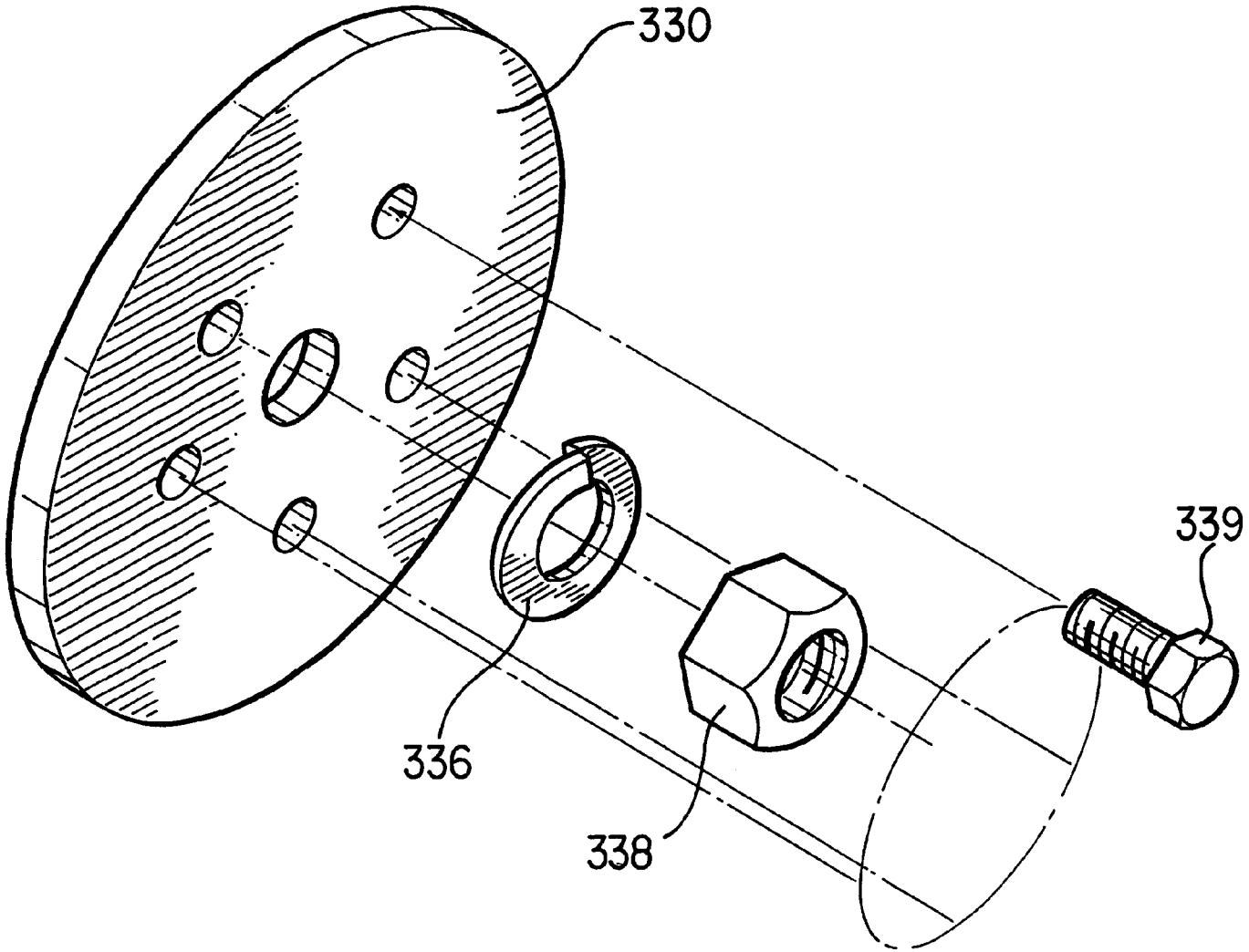
FIG. 6 is an exploded view of another portion of the components included in the right side of the exercise machine.
Figure 7:
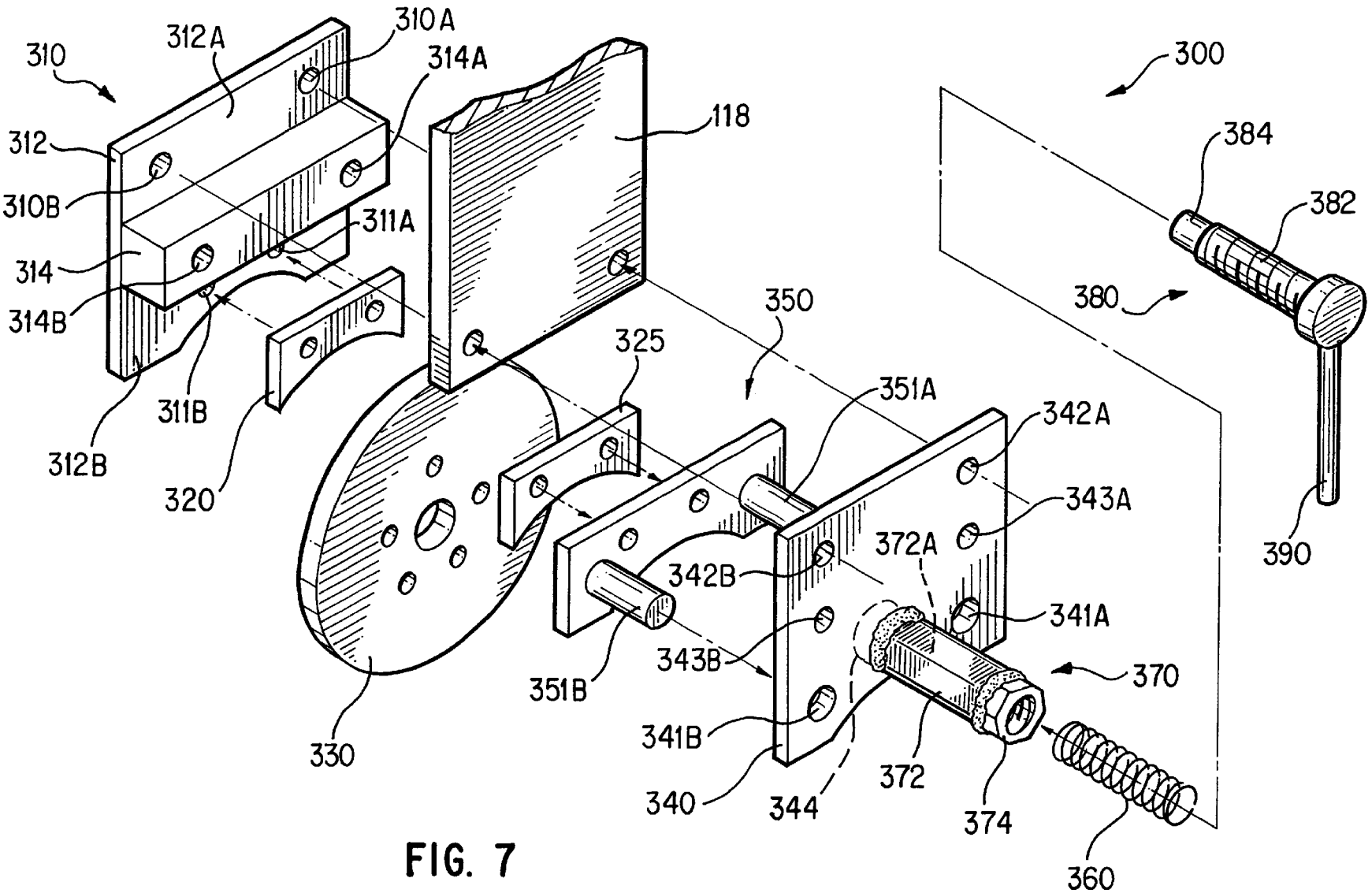
FIG. 7 is an exploded perspective view of an embodiment of a variable resistance mechanism in accordance with the principles of the present invention.

FIG. 4 further illustrates variable resistance mechanism 300 and the apparatus that is utilized to support axle 210, and thus roller 200, on frame 100. FIGS. 5–7 further illustrate the variable resistance mechanism 300 and the right roller retention assembly 600 that is utilized to support roller 200 on the right side of frame 100.

As mentioned above, FIG. 4 illustrates right side 20 of exercise machine 10. In first discussing further how roller 200 is supported on frame 100, reference will be made to FIGS. 4 and 5. Right roller retention assembly 600 includes a bearing assembly 610 and a retainer 620. As can be seen, right roller retention assembly 600 is utilized to support roller 200 on second axle support 116 of frame 100. Right roller retention assembly 600 is associated with the square cross-section portion 212 of axle 210 and with the lower end of second axle support 116.

As can be seen in FIG. 5, right bearing assembly 610 includes a first bearing housing 612, a bearing 614, and a second bearing housing 616. In order to secure roller 200 to second axle support 116, the square cross-section portion 212 of axle 210 is positioned within a cut-out portion in the lower end of second axle support 116. First bearing housing 612 is aligned on second axle support 116 such that the apertures included in first bearing housing 612 are aligned with the apertures included in second axle support 116. Bearing 614, which has a square-shaped aperture included within it that is complementary in shape to axle portion 212 of axle 210, is then positioned on an opposing side of first bearing housing 612 from that which bears against second axle support 116. Second bearing housing 616 is then positioned over bearing 614 and securement hardware is then positioned through the aligned apertures of second bearing housing 616, first bearing housing 612, and second axle support 116 and is utilized to secure right bearing assembly 610 to the lower end of second axle support 116. Thus, in this manner, axle 210 is rotatably secured to second axle support 116.

In order to maintain the relative positioning of axle 210 and second axle support 116, and specifically portion 212 of axle 210 with respect to second axle support 116, a retainer 620 is positioned on axle portion 212 and rigidly secured to axle portion 212 such as, for example, by utilizing a lock screw or bolt which extends through retainer 620 and engages with axle portion 212.

Variable resistance mechanism 300 will now be further described with reference to FIGS. 4–7. As can be seen in FIG. 4, and as will be described further later in this specification, variable resistance mechanism 300 is positioned on resistance mechanism frame extension 118 and a portion of axle 210. Variable resistance mechanism 300 includes brake pads 320 and 325, which are engageable with brake disk 330 in order to provide resistance against rotation of axle 210 of roller 200. Brake pads 320 and 325 are mounted on first plate 310 and second plate 340, respectively, of variable resistance mechanism 300 which are in-turn mounted on frame member 118. As will be discussed further, brake pad 325 is mounted on second plate 340 by attaching brake pad 325 to brake pad plate 350 which is in-turn movably positionable on second plate 340. Brake disk 330 is mounted on threaded portion 214 of axle 210. A variably adjustable compression force can be applied to brake pad plate 350, which is in-turn applied to brake pad 325, by utilizing a compression spring 360 and a compression pinion 380. The variably adjustable compression force is then applied to brake disk 330.

A description will now be provided for the apparatus for mounting brake disk 330 on threaded portion 214 of axle 210. A brake disk mounting plate 334 is secured to brake disk 330 through, for example, connection hardware 339. A first brake disk mounting nut 332 is secured to brake disk mounting plate 334, such as, for example, by welding. The assembled brake disk 330, mounting plate 334, and mounting nut 332 are threaded onto threaded portion 214 of axle 210. First brake disk mounting nut 332 is threaded onto threaded portion 214 of axle 210 to a position which will result in a desired location for brake disk 330 on axle 210. A second brake disk mounting nut 338 is then threaded onto threaded portion 214 of axle 210 and a washer 336 may be included between brake disk 330 and second brake disk mounting nut 338. Thus, as can be understood, brake disk 330 is maintained in position on threaded portion 214 of axle 210 by first and second brake disk mounting nuts 332, 338, respectively.

The attachment of the upper portion of variable resistance mechanism 300 to resistance mechanism frame extension 118 will now be described. First plate 310 is rigidly secured to second plate 340 by utilizing connection hardware 349B. As can be seen in FIG. 7, first plate 310 includes a face plate 312 and a connection member 314 that extends perpendicularly from face plate 312 and toward second plate 340. Face plate 312 includes a connection surface 312A and a brake pad mounting surface 312B. Connection hardware 349A is received through apertures 310A and 310B of connection surface 312A, and similarly through apertures included in second plate 340 which will be described, to retain first plate 310 and second plate 340 on frame member 118. Connection hardware 349A extends through an aperture that is included at a lower end of frame member 118. First brake pad 320 is rigidly attached to brake pad mounting surface 312B of face plate 312. Rivets may be provided through apertures included in first brake pad 320 and apertures 311A and 311B of brake pad mounting surface 312B to secure first brake pad 320 to brake pad mounting surface 312B.

Second plate 340 is a flat plate that includes a plurality of apertures therein. Connection hardware 349A extends through apertures 342A and 342B of second plate 340, through apertures included in the lower end of frame 118, and apertures 310A and 310B of first plate 310 to position the first and second plates on frame member 118. Thus, connection hardware 349A is not primarily utilized to connect first plate 310 to second plate 340, but rather, is utilized to allow the connected first and second plates to be joined to support member 118. Second plate 340 is primarily connected to first plate 310 by inserting connection hardware 349B through apertures 343A and 343B of second plate 340 and into apertures 314A and 314B of first plate 310.

Second brake pad 325 is positioned onto the lower end of second plate 340 through use of brake pad plate 350. Second brake pad 325 is positioned onto a first side of brake pad plate 350. A second, opposite side of brake pad plate 350 includes first and second posts 351A and 351B, respectively. First post 351A is positioned through aperture 341A of second plate 340 and second post 351B is positioned through aperture 341B of second plate 340. Thus, brake pad plate 350 is not rigidly attached to second plate 340, but rather, brake pad plate 350, and thus second brake pad 325, is movably positionable on second plate 340.

Compression spring 360 is primarily disposed on an opposing side of second plate 340 from which is disposed brake pad plate 350. Compression spring 360 extends through aperture 344 in plate 340 such that it engages with a surface of brake pad plate 350 that is between first post 351A and second post 351B. In an embodiment, compression spring 360 is a spring that is able to apply a maximum pressure of 378 pounds per inch on brake pad plate 350 and thus brake disk 330. Thus, as can be understood, compression spring 360 provides for the variably adjustable force that can be applied to brake disk 330 through brake pad plate 350 and second brake pad 325 to provide variable resistance against rotation to axle 210.

Compression spring 360 is at least partially housed within compression spring housing 370. Compression spring housing 370 includes tube 372. Compression spring 360 is at least partially positioned within the internal area of tube 372. Tube 372 is fixed to plate 340 by, for example, welding and is positioned over aperture 344 in plate 340. Thus, spring 360 is positioned partially within tube 372 and extends through aperture 344.

Compression spring housing 370 also includes an internally threaded member, or nut, 374 which may be welded to tube 372 if member 374 is a separately-formed structure from tube 372. A compression pinion 380 is threaded into housing 370. Pinion 380 includes a post 384 and an externally threaded portion 382. Post 384 is received though member 374 and tube 372 and within compression spring 360. Externally threaded portion 382 is threaded into internally threaded member 374 of compression spring housing 370. An actuator 390 is attached to compression pinion 380 in order to assist in rotating pinion 380, and thus, threading pinion 380 into housing 370 which in-turn compresses spring 360. As can be understood, as compression pinion 380 is threaded further into compression spring housing 370, compression spring 360 is further compressed due to its engagement with pinion 380. As compression spring 360 is further compressed, it applies an ever-increasing force against brake pad plate 350, and thus second brake pad 325, as it engages with brake disk 330. Thus, variably adjustable resistance may be provided against brake disk 330 by utilizing compression spring 360 and compression pinion 380. Since compression pinion 380 may be threaded into compression spring housing 370 to a variety of different degrees with each degree providing a different level of compression of spring 360, variably adjustable resistance can be applied to brake disk 330 and thus roller 200.

Figure 8:
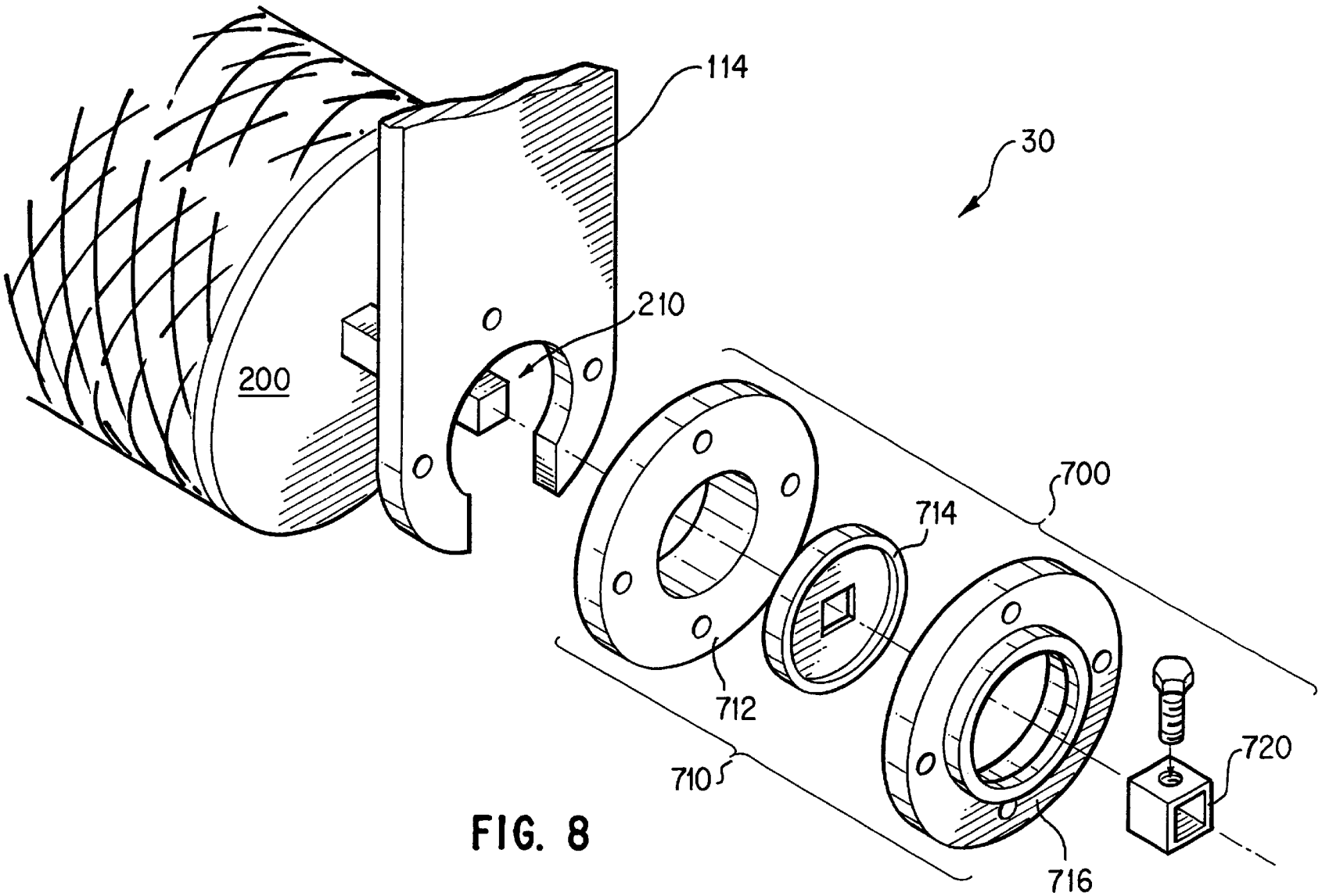
FIG. 8 is an exploded view of a portion of the components included in the left side of the exercise machine.

FIG. 8 illustrates the left side 30 of exercise machine 10. As can be seen, because the variable resistance mechanism 300 is only associated with the right side 20 of exercise machine 10, axle 210 only includes a square-shaped portion in cross-section on the left side 30 of the exercise machine. First axle support 114 of left side 30 is associated with roller 200 similar to the manner in which second axle support 116 was associated with roller 200. As such, axle 210 is positioned within the cut-out portion that is included at the lower end of first axle support 114. A left roller retention assembly 700, which includes left bearing assembly 710 and retainer 720, is utilized to support axle 210 on first axle support 114. Left bearing assembly 710 includes first bearing housing 712, bearing 714, and second bearing housing 716. Left bearing assembly 710 is assembled and positioned onto both axle 210 and first axle support 114 similar to the manner in which right bearing assembly 610 was positioned on second axle support 116 and axle 210. Retainer 720 is positioned on, and secured to, axle 210 similar to the manner in which retainer 620 was secured to axle 210. As such, retainer 720 maintains the relative positioning of first axle support 114 and axle 210. Because left roller retention assembly 700 is similar to right roller retention assembly 600, no further description will be provided herein for left roller retention assembly 700.

Figure 9:
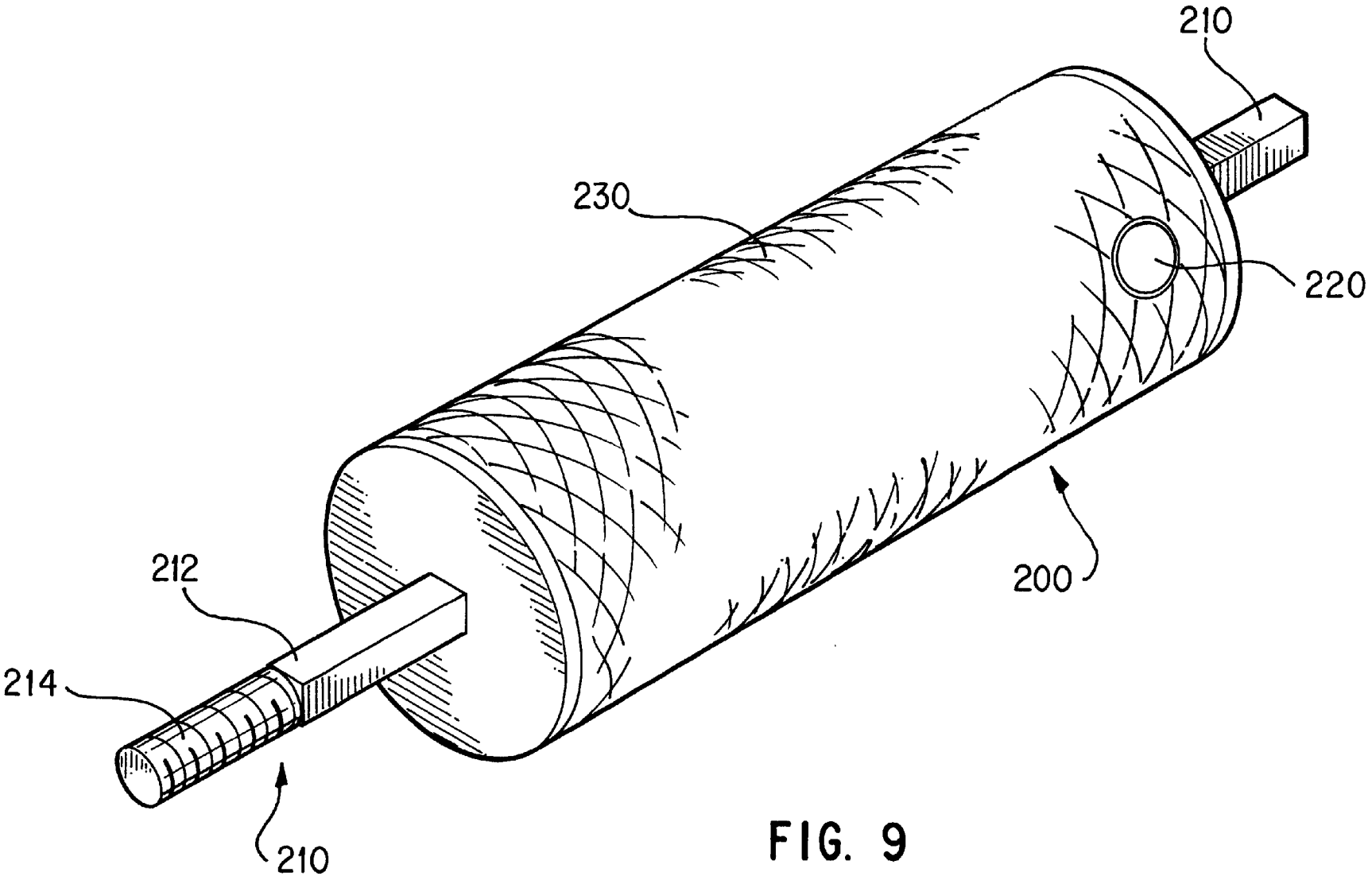
FIG. 9 is a perspective view of an embodiment of a roller in accordance with the principles of the present invention.

FIG. 9 further illustrates roller 200. As can be seen, and as described previously, axle 210 includes a square-shaped portion 212 which extends through roller 200 and a threaded portion 214 that is associated with variable resistance mechanism 300. Because of the complementary structures of axle portion 212 and the bore through roller 200, in which axle portion 212 is received, axle 210 rotates along with roller 200. As was previously described, roller 200 may include an aperture 220 through which additional weight may be added to the interior of roller 200. Additionally, as discussed previously, any of a variety of materials 230 may be applied to the outer surface of roller 200. Materials that could be applied to the outer surface of roller 200 to provide for additional resistance could include expanded metals and other materials that have discontinuities in their surfaces, e.g., raised portions from the surface of the material.

As discussed previously, the present invention is not limited to any particular dimensions for roller 200, however, in a particular embodiment, the roller has a length of 24 inches and a diameter of 8 inches.

As described above, an exercise machine is provided that includes a mechanism for variably adjusting the resistance provided by the exercise machine against a pulling force applied by the user of the exercise machine. The exercise machine provides the advantages of including a roller that is comprised of a single structural member. The roller may be elongated in length to provide a greater surface area for contact with the ground surface for enhancing the resistance provided by the exercise machine, when compared against exercise machines that are supported on wheels. The present invention includes an elongated roller but does not require an excessive width for the exercise machine as a whole due to the present invention's positioning of the roller within the frame structure of the exercise machine and the variable resistance mechanism's positioning external to the roller and frame. Thus, the variable resistance mechanism is able to be comprised of a relatively simple structure since it does not have to associate with, and thus be positioned between, two wheels which support an exercise machine.

Representative resistance forces that may be provided by the exercise machine are provided below. An embodiment of the exercise machine weighs approximately 125 pounds, without any additional weight being added to the roller. Without applying a resistance force to the roller by the variable resistance mechanism, a force of approximately 20 pounds is required to pull the exercise machine along the ground surface. When the variable resistance mechanism applies a maximum resistance force to the roller, a force of approximately 90 pounds is required to pull the exercise machine.

If an additional weight of 150 pounds is added to the roller of the exercise machine, a force of approximately 35 pounds is required to pull the exercise machine when no resistance force is applied by the variable resistance mechanism. With the same weight of 150 pounds added to the roller and a maximum resistance force applied by the variable resistance mechanism, a force of 160 pounds is required to pull the exercise machine against the resistance provided by the exercise machine. Thus, as can be understood, when a weight of 150 pounds is added to the roller, the force required to pull the exercise machine increases by 15 pounds when no resistance is provided by the variable resistance mechanism. When maximum resistance is applied, 125 pounds of force is required to overcome the resistance provided by the exercise machine.

Whereas the present invention is described as being pulled by a user, the present invention can also be utilized by being pushed by the user. Additionally, the disclosed embodiments are illustrative of the various ways in which the present invention may be practiced. Other embodiments can be implemented by those skilled in the art without departing from the spirit and scope of the present invention.

What is claimed is:

1. An exercise machine, comprising:

a frame having a first axle support and a second axle support;

a roller disposed between said first axle support and said second axle support;

an axle extending through said roller and having a portion extending external to said second axle support; and a variable resistance mechanism coupled to said external portion of said axle, wherein said frame further includes:

an overhead frame having a first arm and a second arm, wherein said first axle support is attached to said first arm and extends perpendicular to said first arm and wherein said second axle support is attached to said second arm and extends perpendicular to said second arm, and a front frame including:

a first arm;

a second arm;

a first arm extension;

a second arm extension;

a first cross member; and a second cross member;

wherein a first end of said first arm of said front frame is attached to a first end of said first arm of said overhead frame, said first arm of said front frame extending forwardly and downwardly from said first arm of said overhead frame, and wherein a first end of said second arm of said front frame is attached to a first end of said second arm of said overhead frame, said second arm of said front frame extending forwardly and downwardly from said second arm of said overhead frame;

wherein a first end of said first arm extension is attached to a second end of said first arm of said front frame and wherein a first end of said second arm extension is attached to a second end of said second arm of said front frame;

wherein said first cross member is attached to said first ends of said first and second arm extensions and wherein said first cross member extends perpendicularly to said first and second arm extensions;

wherein said second cross member is attached at a first distal end to a second end of said first arm extension and at a second distal end to a second end of said second arm extension and wherein said second cross member extends perpendicularly to said first and second arm extensions.

2. The exercise machine of claim 1 wherein said frame further includes:

a rear frame having a first arm and a second arm;

wherein a first end of said first arm of said rear frame is attached to a second end of said first arm of said overhead frame, said first arm of said rear frame extending rearwardly and downwardly from said first arm of said overhead frame, and wherein a first end of said second arm of said rear frame is attached to a second end of said second arm of said overhead frame, said second arm of said rear frame extending rearwardly and downwardly from said second arm of said overhead frame;

wherein a second end of said first arm of said rear frame is connected to a second end of said second arm of said rear frame.

3. The exercise machine of claim 1 further comprising a support member, said support member attached to a mid-portion of said second cross member and extending perpendicular to said second cross member.

4. The exercise machine of claim 3 wherein said support member includes a skid at a first end thereof.

5. The exercise machine of claim 4 further comprising a harness assembly coupled to a second end of said support member.

6. The exercise machine of claim 1 further comprising an extension member attached to said frame, said extension member disposed on an external side of said second axle support and wherein a portion of said variable resistance mechanism is coupled to said extension member.

7. An exercise machine, comprising:

a frame having a first axle support and a second axle support;

a roller disposed between said first axle support and said second axle support;

an axle extending through said roller and having a portion extending external to said second axle support;

a variable resistance mechanism coupled to said external portion of said axle; and an extension member attached to said frame, said extension member disposed on an external side of said second axle support and wherein a portion of said variable resistance mechanism is coupled to said extension member, wherein said variable resistance mechanism includes:

a first plate having a first brake pad;

a second plate having a second brake pad movably disposed on said second plate, wherein said first plate is connected to said second plate and wherein said first and second plates are coupled to said extension member;

a brake disk coupled to said external portion of said axle and disposed between said first and second brake pads; and a compression spring disposed through an aperture included in said second plate and engageable with said second brake pad.

8. The exercise machine of claim 7 wherein said variable resistance mechanism further includes a compression spring housing attached to said second plate wherein at least a portion of said compression spring is disposed within said compression spring housing.

9. The exercise machine of claim 8 wherein said variable resistance mechanism further includes a compression pinion, said compression pinion threadedly received within said compression spring housing and engageable with said compression spring.

10. The exercise machine of claim 9 wherein said variable resistance mechanism further includes an actuator attached to said compression pinion.

11. The exercise machine of claim 7 wherein said brake disk is coupled to a threaded portion of said external portion of said axle.

12. An exercise machine, comprising:

a main frame including:

an overhead frame;

a front frame attached to a first end of said overhead frame; and a rear frame attached to a second end of said overhead frame;

wherein said main frame is formed in an inverted u-shape configuration and defines an internal area defined by said overhead frame, said front frame, and said rear frame;

a roller attached to a lower end of said overhead frame and disposed within said internal area;

an axle extending through said roller and having a portion extending external to said internal area;

a frame extension member attached to said overhead frame and disposed external to said internal area; and a variable resistance mechanism coupled to said external portion of said axle and said frame extension member.

13. The exercise machine of claim 12 wherein said variable resistance mechanism includes:

a first plate having a first brake pad;

a second plate having a second brake pad movably disposed on said second plate, wherein said first plate is connected to said second plate and wherein said first and second plates are coupled to said frame extension member;

a brake disk coupled to said external portion of said axle and disposed between said first and second brake pads; and a compression spring disposed through an aperture included in said second plate and engageable with said second brake pad.

14. The exercise machine of claim 13 wherein said variable resistance mechanism further includes a compression spring housing attached to said second plate wherein at least a portion of said compression spring is disposed within said compression spring housing.

15. The exercise machine of claim 14 wherein said variable resistance mechanism further includes a compression pinion, said compression pinion threadedly received within said compression spring housing and engageable with said compression spring.

16. The exercise machine of claim 13 wherein said first plate includes a face plate and a connection member extending perpendicular from said face plate.

17. The exercise machine of claim 16 wherein said first brake pad is attached to a lower end of said face plate.

18. The exercise machine of claim 13 wherein said second brake pad is mounted on a first side of a brake pad plate, said brake pad plate including a first post and a second post on a second side of said brake pad plate, said first post and said second post movably received within apertures defined by said second plate.

19. The exercise machine of claim 12 further comprising a support member, said support member attached to said front frame.

20. The exercise machine of claim 19 wherein said support member includes a skid at a first end thereof.

21. The exercise machine of claim 19 wherein said support member includes a wheel at a first end thereof.

22. The exercise machine of claim 19 further comprising a harness assembly coupled to a second end of said support member.

* * * * *